United States Patent [19]

Heidenberger

[11] 3,947,330

[45] Mar. 30, 1976

[54] METHOD OF ELECTRODEPOSITION

[75] Inventor: Guenter J. Heidenberger, New Berlin, Wis.

[73] Assignee: Roli Chemical, Ltd., Milwaukee, Wis.

[22] Filed: Feb. 12, 1975

[21] Appl. No.: 549,165

[52] U.S. Cl. ..... 204/17; 204/6

[51] Int. Cl.[2] ..... B41C 3/08

[58] Field of Search ..... 204/12, 3, 4, 6, 281, 17

[56] References Cited

UNITED STATES PATENTS

| | | | |
|---|---|---|---|
| 528,042 | 10/1894 | Stouls | 204/281 |
| 1,945,142 | 1/1934 | Fichtmueller | 204/12 |
| 2,287,122 | 6/1942 | Norris | 204/11 |
| 3,046,203 | 7/1962 | Cadwell | 204/281 |

*Primary Examiner*—T. M. Tufariello

[57] ABSTRACT

A capsule containing albumin, preferably egg albumin, is disclosed. The contents of the capsule may be dissolved in water to form a parting solution useful in rotogravure printing. The solution is used to prevent bonding of an electro-deposited copper ballard shell onto the base cylinder and to facilitate easy removal of the shell once the printing run is completed.

3 Claims, No Drawings

METHOD OF ELECTRODEPOSITION

BACKGROUND OF THE INVENTION

This invention relates generally to the art of rotogravure printing and in particular to the preparation of a parting solution.

One procedure used in the rotogravure industry for preparing printing cylinders comprises providing a base cylinder which is undersized by approximately 0.006 inches. The base cylinder is cleaned and degreased and is then immersed into a copper plating bath. The negative terminal of a power supply is connected to the base cylinder and positive leads from the power supply are connected to suitable electrodes in the copper plating bath. A voltage is then applied to cause a thin copper coating to be formed on the base cylinder, which coating is then engraved for the printing operation. The details of the plating and printing processes are not provided because such processes are well known to the art.

Because the base cylinders are quite expensive, it is necessary to remove the electro-deposited copper before preparing new printing cylinders. In the past this has usually been accomplished by placing the used cylinder in a lathe and turning the cylinder down to its original size. Such an operation is both time consuming and expensive, and great care is required to control cylinder dimensions with desired limits.

Recently, it has been discovered that the base cylinder can be treated prior to the electro-deposition step to yield a final cylinder which has improved properties. For example, various solutions of mercuric and silver salts can be applied to a cleaned and degreased base copper cylinder by pouring the solution over the cylinder or swabbing the solution on the cylinder with an applicator pad. This solution is known to the art as a "parting solution". The parting solution is rinsed from the cylinder with water and the cylinder is then plated in a conventional manner. The improvement results from the easy removability of the electro-deposited copper shell, which, instead of being turned down with a lathe, can be merely stripped off.

While such parting solutions have become quite popular in the industry from the both a cost and quality control standpoint, they do suffer from several disadvantages including toxicity and pollutant problems. Such prior art parting solutions are, in fact, so highly toxic that their continued use may be prohibited by regulartory agencies of both federal and state governments. It would be highly desirable, therefore, to have a parting solution of equal effectiveness which does not suffer from these drawbacks.

OBJECTS OF THE INVENTION

It is a primary object of the present invention to provide a quantity of a suitable solid which may be dissolved in water to form a parting solution which is non-toxic and practically non-polluting.

It is a further object of the present invention to provide a quick and easy method of preparing an albumin-base parting solution for the rotogravure industry.

It is another object of the present invention to provide materials useful for preparing a parting solution which materials are highly stable and which have an extended shelf-life.

How these and other objects of the invention are accomplished will be described in the following specification. Generally however, the invention comprises providing a quantity of albumin, preferably egg albumin, in capsule or tablet form, dissolving the albumin in water to form a parting solution, treating a base copper or copper alloy cylinder with the parting solution, plating copper onto the treated base cylinder, printing with the cylinder and removing the electro-deposited copper shell from the base cylinder.

DESCRIPTION OF THE PREFERRED EMBODIMENT

In a preferred form the present invention comprises a quantity of egg albumin in a capsule or tablet form. For purposes of describing the present invention, the quantity will be taken as 400 mg. since such amount dissolved in one gallon of water will provide a parting solution of the desired concentration. However, other size capsules or tablets can be employed, depending on the desired size and concentration of the final batch of parting solution.

Egg albumin is only one of several suitable albumins which are considered to be within the scope of the present invention. Albumins are generally defined as those simple proteins which when cleaved by acids or enzymes produce only amino acids. Many such albumins occur naturally such as, for example, grain albumin, ovalbumin, soy bean albumin, serum albumin and lactalbumin. Egg albumin itself is a yellowish powder which is isolated from fresh egg white, and it takes approximately 7—8 parts of egg white to produce 1 part of albumin. The powder itself is susceptible to attack by moist air, producing ammonia.

It has been found by the present inventor that liquid solutions of albumin parting solutions are impractical from a commercial standpoint since deterioration results in a "rottenegg" smell after relatively short storage periods. Attempts to retard the deterioration by the use of preservatives adds to the cost of the solutions and is not entirely effective.

Accordingly, preparation of small batches of the parting solution is preferred and the preparation of small batches is expedited by the initial preparation of tablets or capsules of the albumin powder. Capsules are most convenient because the capsule itself protects the contents from air and a loose powder is easier to dissolve in water then is a tablet. However, tablets, with or without fillers such as sodium carbonate, are equally effective.

The procedure for preparing cylinders employing the present invention will now be described. A base copper cylinder which has been polished and degreased is treated with a 5% sulfuric acid solution to deoxidize the copper surface. The cylinder is then rinsed in water to remove the acid. A small batch of parting solution is prepared by breaking a capsule containing 400 mg. of egg albumin into a container holding one gallon of water. After the solid has dissolved, the parting solution is applied to the cleaned and degreased base cylinder by pouring the solution over the cylinder or wiping the cylinder with an applicator soaked in the parting solution. The treated cylinder is again washed in water and plated in a conventional manner.

While the invention has been described in connection with rotogravure printing, it has equal applicability to all uses wherein copper or other metals are electro-deposited onto a base and where the coating is stripped from the base prior to reuse. Those skilled in the art will appreciate that the concentration, quantities and procedures just described can be varied depending on the particular technology involved. The capsules or tablets described above can be made in any desired size and may include the various preservatives and plating addition agents known to the art.

So while the invention has been illustrated by reference to a particular embodiment, the invention is not to be limited thereby but it to be limited solely by the claims which follow.

I claim:

1. A process for preparing a rotogravure printing cylinder comprising:

a. providing a metallic base cylinder, b. cleaning, degreasing and deoxidizing said base cylinder, c. preparing a parting solution consisting of egg albumin and water in a concentration of approximately 400 mg. of egg albumin per gallon of water, said step of preparing comprising dissolving egg albumin in capsule form in water, d. applying a film of said parting solution onto said base cylinder, and e. electro-depositing a shell of metal onto the treated cylinder.

2. The process of claim 1 wherein said step of preparing consists of dissolving a tablet comprising compressed egg albumin in water.

3. A process as set forth in claim 1 wherein said electrodeposited metal is copper and said base cylinder comprises a metal selected from the group consisting of copper and copper alloys.

* * * * *